United States Patent [19]

Ellen

[11] Patent Number: 4,676,045

[45] Date of Patent: Jun. 30, 1987

[54] POST-TENSIONED STEEL STRUCTURE

[75] Inventor: Peter E. Ellen, Hong Kong, Hong Kong

[73] Assignee: Elspan International Limited, Hong Kong

[21] Appl. No.: 931,020

[22] Filed: Nov. 17, 1986

Related U.S. Application Data

[63] Continuation of Ser. No. 784,513, Oct. 4, 1986, abandoned.

[30] Foreign Application Priority Data

Nov. 29, 1984 [AU] Australia ..... PG8350

[51] Int. Cl.[4] ..... E04G 21/14; E04C 3/11; E04C 3/10; E04B 7/00

[52] U.S. Cl. ..... 52/745; 52/86; 52/223 R; 52/640; 52/644; 52/741

[58] Field of Search ..... 52/86, 223 R, 226, 640, 52/644, 741, 745

[56] References Cited

U.S. PATENT DOCUMENTS

| | | | |
|---|---|---|---|
| 1,554,061 | 9/1925 | Wylie | 52/644 X |
| 3,530,622 | 9/1970 | Cohen | 52/86 |
| 3,676,964 | 7/1972 | Anglade, Jr. | 52/745 X |
| 3,708,944 | 1/1973 | Miyake | 52/745 |
| 4,052,834 | 10/1977 | Ellen | 52/640 X |
| 4,223,506 | 9/1980 | Blair et al. | 52/86 X |
| 4,325,207 | 4/1982 | Russell et al. | 52/86 X |
| 4,373,305 | 2/1983 | Russell | 52/86 |

FOREIGN PATENT DOCUMENTS

| | | | |
|---|---|---|---|
| 505679 | 11/1979 | Australia . | |
| 103419 | 1/1942 | Sweden | 52/640 |

*Primary Examiner*—Alfred C. Perham
*Attorney, Agent, or Firm*—Holman & Stern

[57] ABSTRACT

A method of constructing and erecting a post-tensioned steel frame structure consisting in:

1. Constructing on the ground a center span of the structure to each end of which are hingedly connected column structures;
2. Post-tensioning the center span by means of a cable to bring the span to a desired shape; and
3. Post-tensioning cables connected between each said column structure and the center span to produce relative rotational movement between the column structures and the center span about the hinge joints to raise the column structures from a substantially horizontal to a substantially vertical position thereby elevating the center span to its final position.

2 Claims, 13 Drawing Figures

POST-TENSIONED STEEL STRUCTURE

This is a continuation of application Ser. No. 784,513, filed Oct. 4, 1986 now abandoned.

The present invention relates to post-tensioned steel, concrete or timber strutures intended for use in the erection of buildings such as farm buildings, factories and aircraft hangars in which it is necessary to enclose a large area under a peripherally supported roof in an effective but economical manner.

The present invention utilizes post tensioning techniques for the construction of trusses such as for example that described in Australian patent No. 505,679 wherein the roof of a building may be constructed as a whole unit from a plurality of truss-frames interconnected by a plurality of truss-purlins carrying the roof covering material.

The geometric arrangement of truss systems composed in the case of an end supported span (not intermediately supported) of an upper chord which acts as a compression member consisting before reaction of a straight or partially curved member and a tensioned cable lower chord member encased in a metal tube(s) preferably steel.

On tensioning the lower chord, the forces being resisted by the upper chord, the lower chord length will change, according to the deflection of the upper and the relative distance between the upper and lower chords as defined by the vertical or diagonal ordinated between these members.

The respective lengths of each of the lower chord tube(s) segment(s) containing the tension cable(s) between the ends of the vertical/diagonal ordinates defines the curved shapes of each of the upper and lower chords. These segmental lengths may be adjusted to provide any required change in curvature of the top chord.

For relatively small changes in curvature the upper chord may bend in flexure but when the length of the lower chord segment is further reduced the upper compression chord is subjected to severe bending which may be reduced by hinge mechanisms, to enable the top chord to deflect from 0° to more than 90°.

Structural systems such as arches, portal frames, continuous frames etc. may be erected by such joint closures and the degree of rotation being limited only by the length of the compression tube(s) containing the tension member(s).

When the lower chord is tensioned until each lower chord tube contacts the next vertical/diagonal ordinate, by further tensioning, the tube(s) are compressed resisting any further shape change in either the upper or lower chords.

The greater the applied cable tension forces in excess of that required to lift or form the structure the greater the stored energy in the compressed lower chord tube(s) and the greater the outward load created in the vertical/diagonal tension members between the upper and lower chords. The preload force system is used to react against loads applied to the structure due to wind, earthquake and live loads, to greatly increase the structural strength and stiffness.

Typical preload forces range from 0.1 to 100 or more times the forces required to form the shape of the structure.

When the lower chord members are resisting the compression force, the deformations between the lower chord segments are controlled by the space between the tensioned cables(s) and the inside of the tube members. This space or clearance may range from 3 mm. to more than 100 mm. depending on the ratio or the least tube dimension to the distance between the vertical/diagonal ordinates and the desired degree of camber between each chord member.

The creation of segment deformations also creates additional truss curvature depending on the length and depth of the truss. The void space between the cable(s) and the tube(s) walls is grouted with a cementious material (usually portland cement, water and chemical additives) to bond the cable(s) to the tube and to interact between the tube(s) and wall(s) at the sliding joint where the tube lengths overlap at the compression resisting joint.

The tube walls of this compression joint are composed of shaped members having corrugations with preferably planar slopes ranging from TAN O=0.1-1.0 and depth of corrugation from 1 mm. to 10 mm. or more.

These formations are filled with grout bonding materials and may be designed to resist the total tube tensile strength.

When the structure is subjected to load creating forces in the lower chord greater than the cable force(s) the tube compression is changed to tension which is transmitted along the lower chord by the tensile strength of the tube materials and the bonded joint.

The principle of a curved cable creating forces which may be applied to resist the external applied loads on the structure is well known. However, this concept relates to the use of the curved cable(s) and compression member(s) of a different curvature reacting together to create force(s) to resist the applied external load(s) on the truss beam systems.

The lower chord compression tube(s) stores the excess cable energy and releases it in the same method and manner of the tensioned cable, when the external forces are applied.

By way of example the tensioning of a post-tensioned cable contained in the upward curving lower chord of a roof truss purlin/beam creates downward applied forces thereby resisting the wind upward forces. The energy of these forces in excess of that required to support the structure self weight stored in the lower chord members of precompression of the tube(s), without excessive deformation of the structure.

The technique described above may be utilised in the present invention in the construction of a structure that can be assembled at ground level, post-tensioned to bring a centre span of the structure to a desirable configuration and thereafter post-tensioned to raise the structure into its final form, shape and curvature without the use of cranes.

The present invention consists in a method of constructing and erecting a post-tensioned steel frame structure consisting in:-

1. Constructing on the ground a centre span of the structure to each end of which are hingedly connected column structures;
2. Post-tensioning said centre span by means of a cable to bring the span to a desired shape; and
3. Post-tensioning cables connected between each said column structure and the centre span to produce relative rotational movement between said column structures and said centre span about said hinge joints to raise the column structures from a substantially horizontal to a substantially vertical position thereby elevating the centre span to its final position.

The invention further consists in a post-tensioned frame structure constructed by the abovementioned method and to buildings constructed from a plurality of said frame structures arranged side by side and interconnected by purlins which may also be of post tensioned construction, the purlins being covered by roofing material.

In order that the nature of the invention may be better understood and put into effect preferred forms thereof are hereinafter described by way of example with reference to the accompanying drawings in which:-

FIGS. 1*a*, 1*b* and 1*c* show a post-tensioned portal frame in various stages of erection;

Figure 4A:
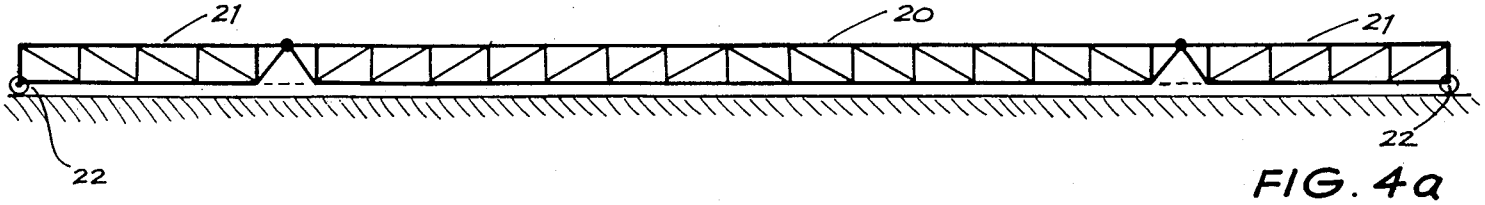
Figure 4B:
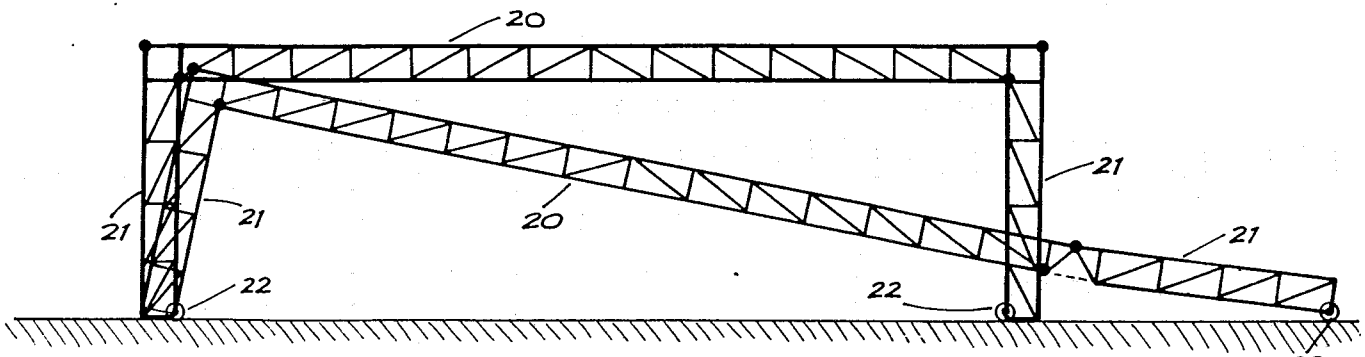
Figure 5:
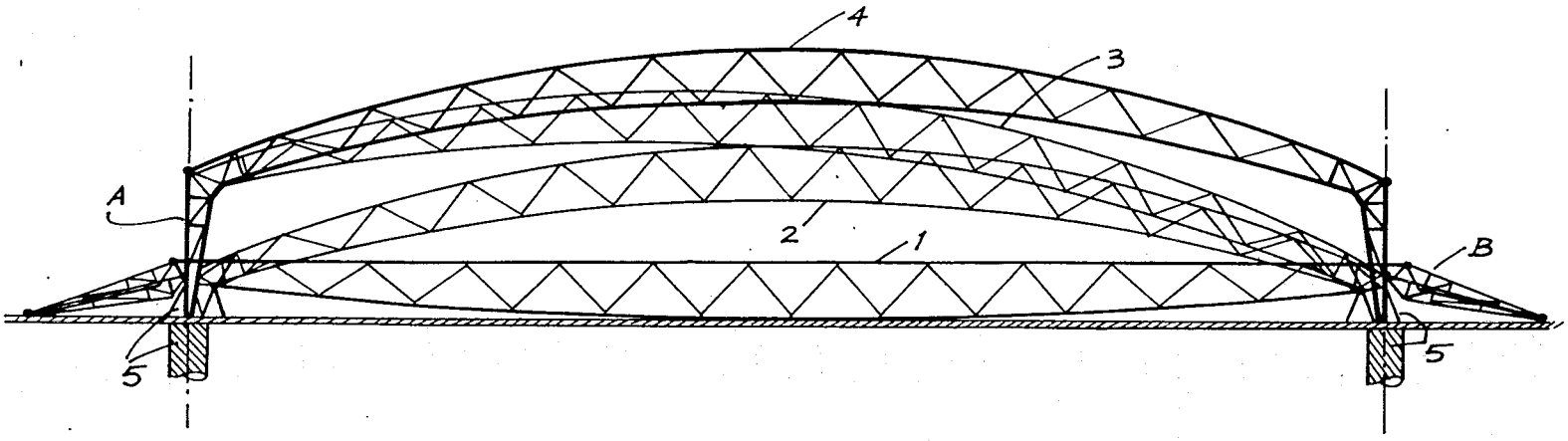
Figure 6:
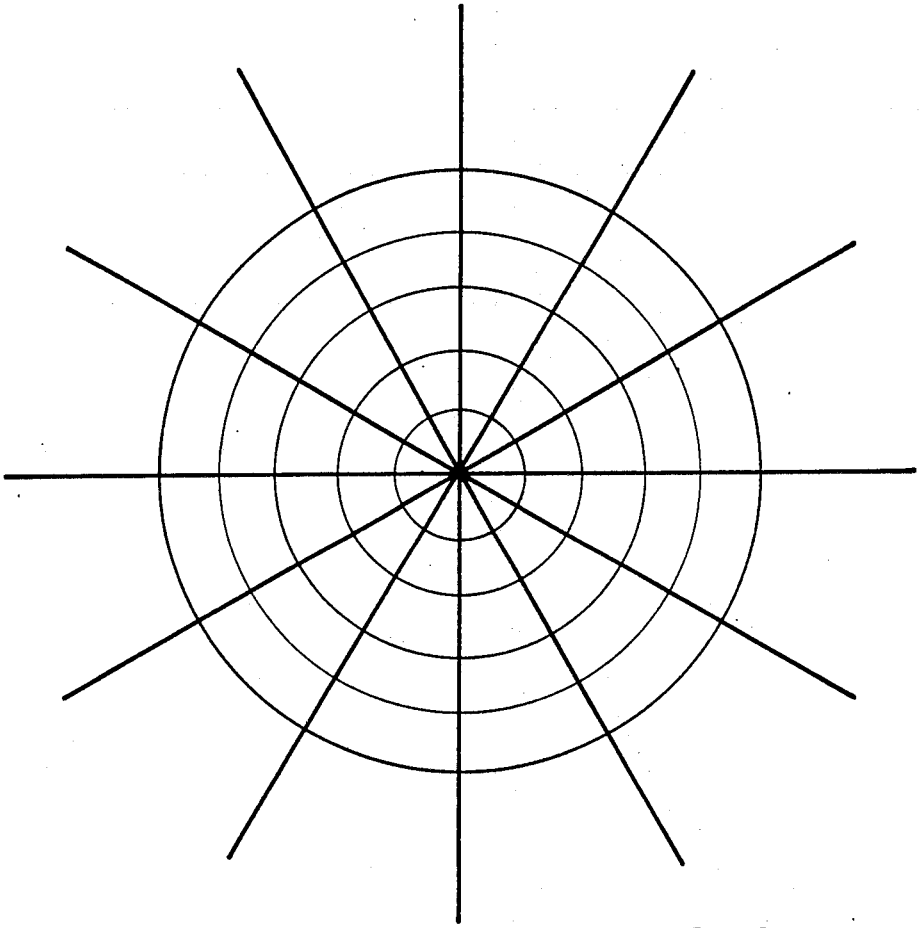
Figure 7:
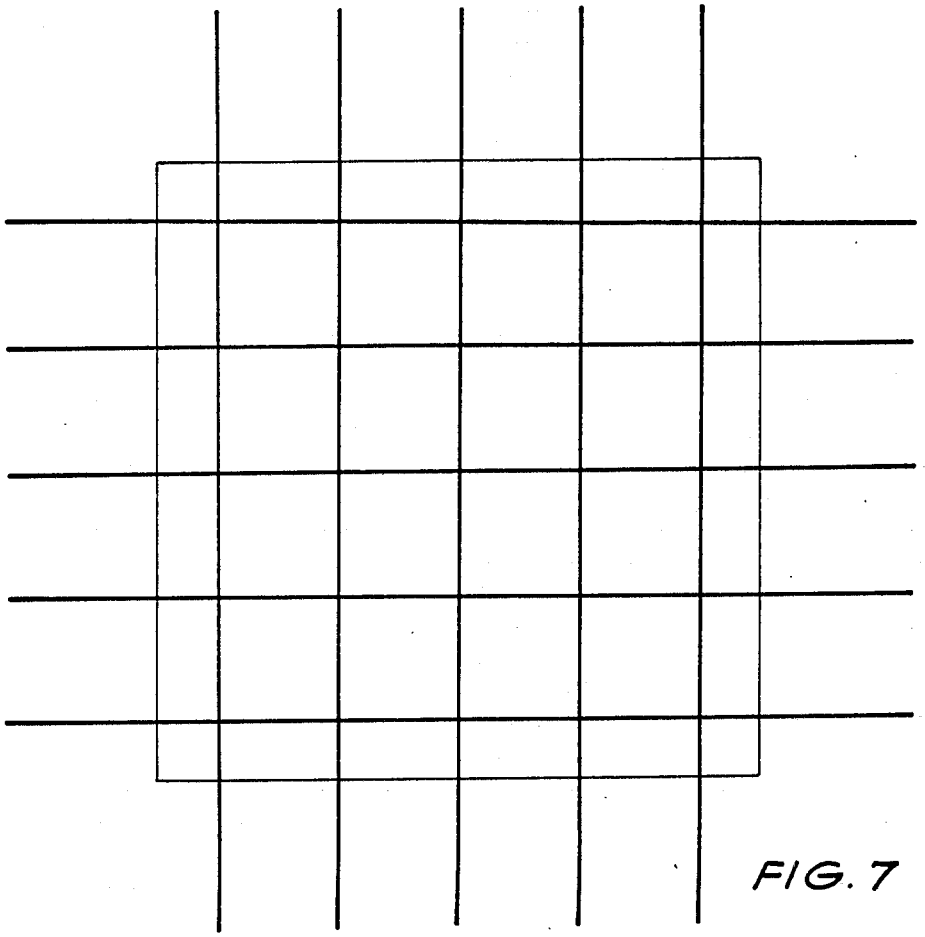
Figures 8, 9, 10:
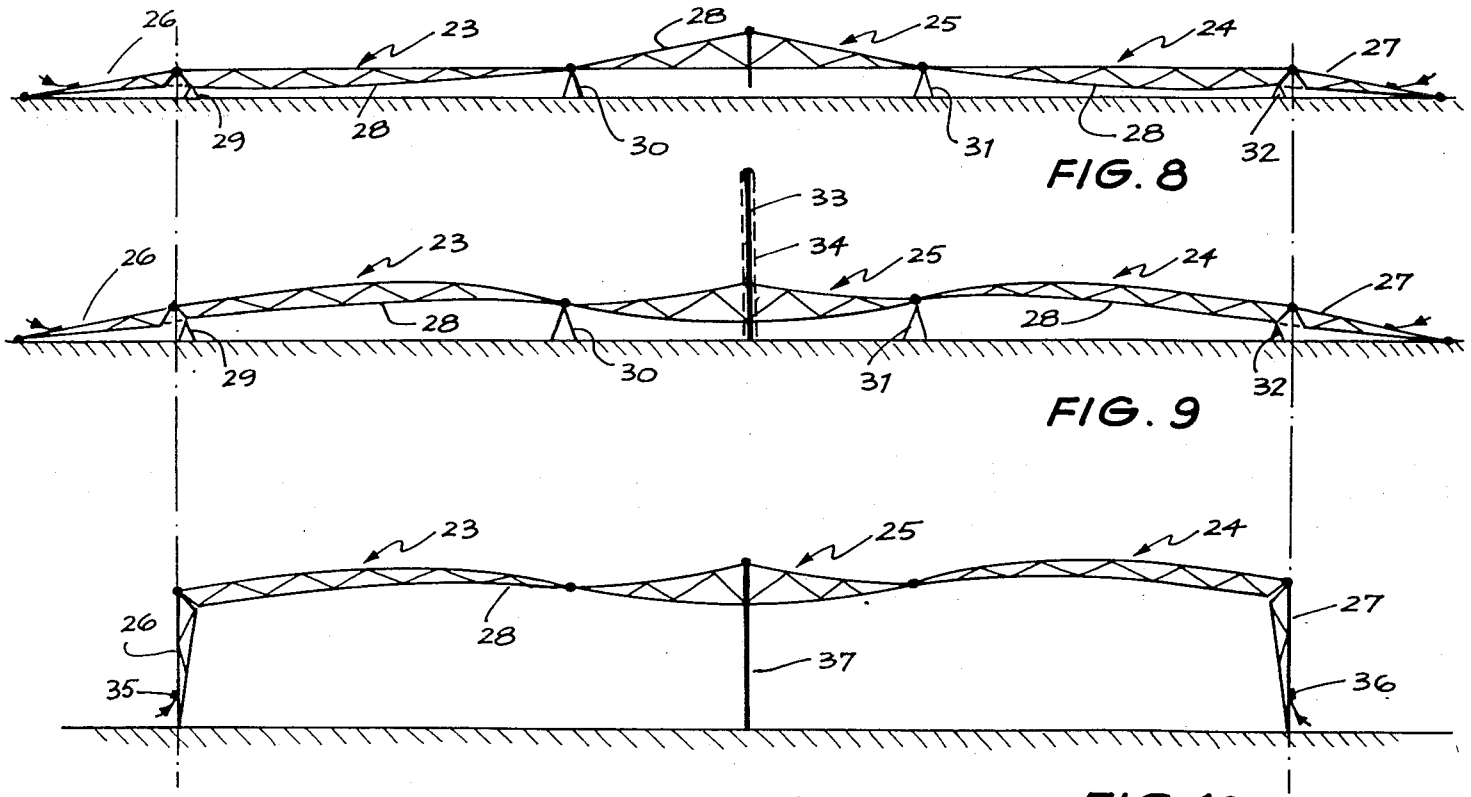

FIGS. 4*a* and 4*b* illustrate the construction and erection of a post-tensioned portal frame (parallel chord type);

FIG. 5 illustrates stages in the construction and erection of a post-tensioned portal truss;

FIG. 6 illustrates the invention as applied to a circular structure;

FIG. 7 illustrates the invention as applied to a rectangular structure,

FIGS. 8, 9 and 10 illustrate the application of the invention to a form of construction in which the centre span is made up of a plurality of separate sections.

Figures 1A, 1B, 1C:
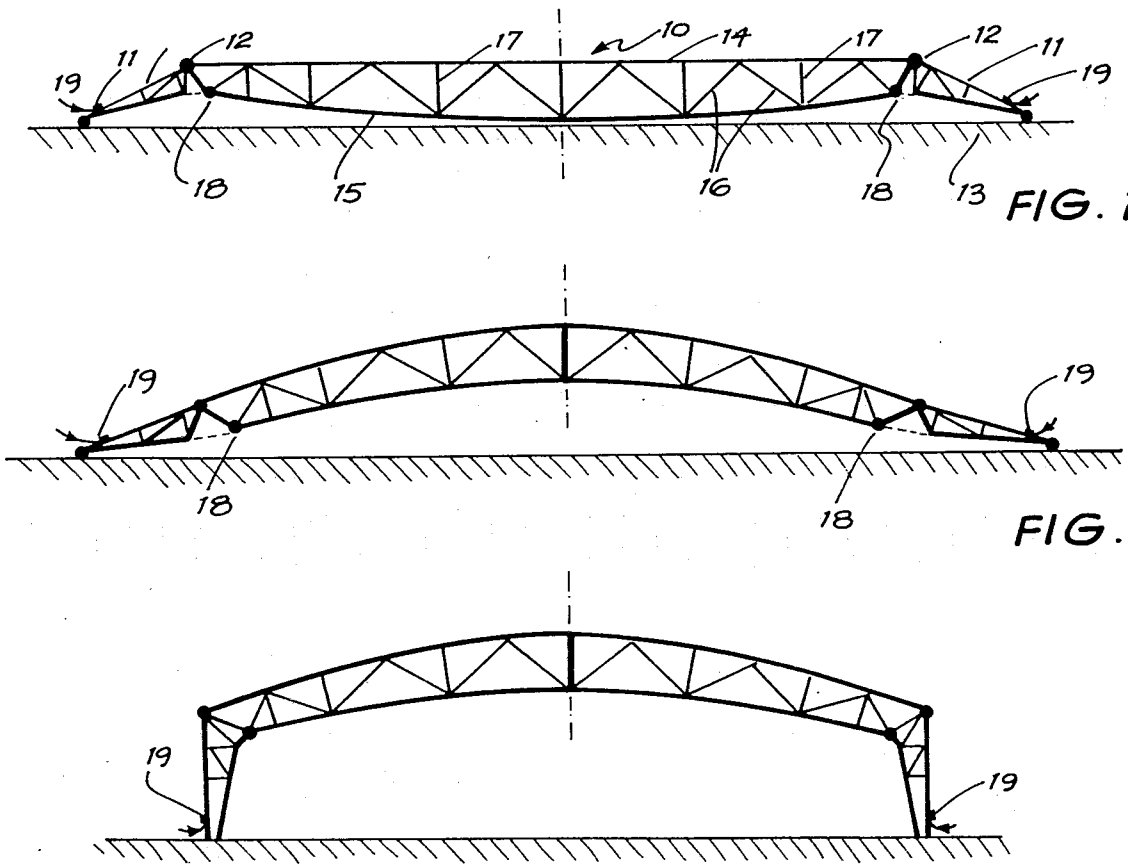

In FIGS. 1*a*, 1*b* and 1*c* a post-tensioned portal frame (parabolic type) is illustrated which consists of a centre span 10 to each end of which a column structure 11 is hingedly attached by means of hinge joints 12. FIG. 1*a* shows the whole assembly laid out flat on a suitable base 13.

The centre span consists of an upper chord 14 and a lower chord 15 made preferably of tubular steel members interconnected by diagonal members 16 and/or vertical members 17. A tensioning cable runs through the lower chord 15 and on being tensioned brings the structure to the configuration shown in FIG. 1*b*. After post-tensioning, the ends of the cable are anchored at points 18. Further cables extend from the points 18 along each column structure 11 to points 19. Tensioning of these cables, which is done normally as a group but may be done progressively one by one, causes each column structure 11 to pivot about the hinge joint 12 in relation to the centre span to bring the column structure from a more or less horizontal position as shown in FIG. 1*b* to a vertical position as shown in FIG. 1*c*. As is best seen in FIG. 2 the adjacent ends of the centre span 10 and the column structures 11 are shaped to permit the column structures to be brought to a vertical position.

The ends of these cables are then anchored at points 19 and may be carried down into the foundations to hold the building to the ground against wind loads.

It is to be noted that the invention enables the structure to be erected without the use of cranes. A further point to be noted is that while, by the application of techniques described in the preamble to this specification it would be possible to erect an arch type structure without the use of the hingedly attached column structures the present invention enables a structure to be erected in which the centre span is supported above the ground at a very substantial height equal to the height of the column structures.

Figure 2:
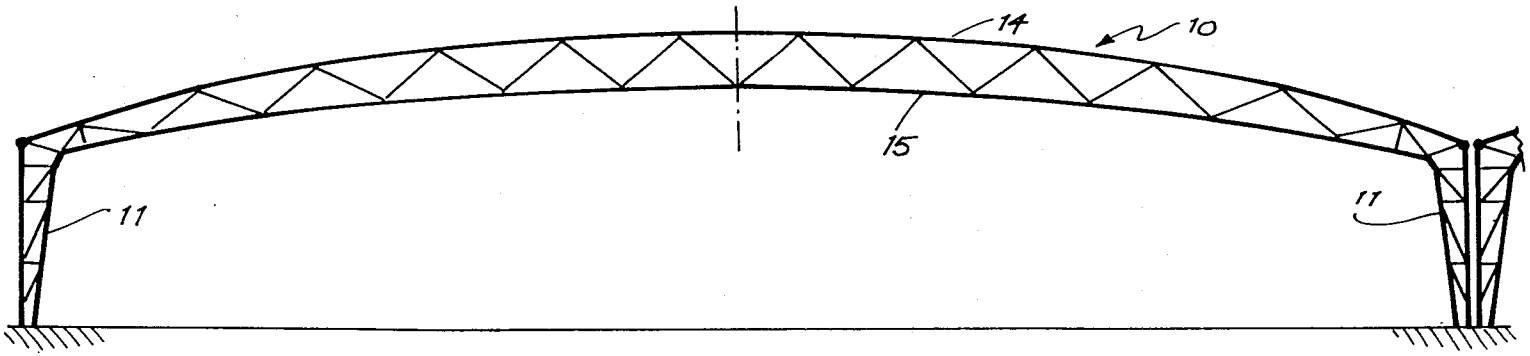
FIG. 2 shows a completely erected post-tensioned portal frame.
Figure 3:
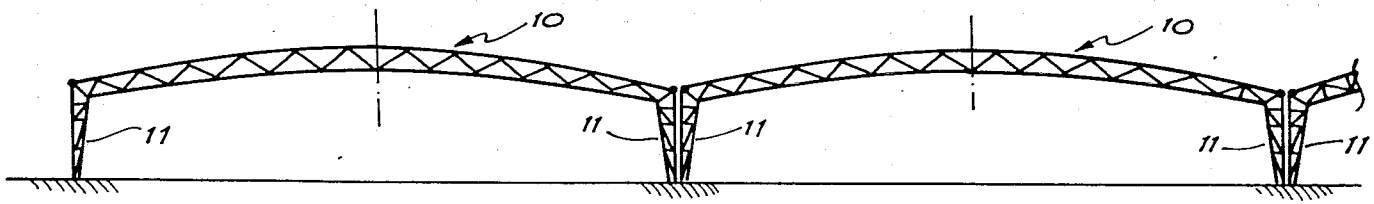
FIG. 3 shows a number of the frames of FIG. 2 arranged in a multi-bay construction.

FIG. 2 shows a completed post tensioned portal frame structure of the kind described above and FIG. 3 shows two such structures arranged side by side as part of a multi-bay construction.

FIGS. 4*a* and 4*b* show a variation on the construction of FIGS. 1*a* to 1*c* in that the centre span 20 is of the parallel chord type as are the column structures 21. The method of erection is as described in connection with FIGS. 1*a* to 1*c*. In most constructions the erection is assisted by means of roller wheel 22 arranged on the lower extremities of the column structures which are arranged to roll in suitable guides laid on the surface of which the structure is being erected.

FIG. 5 illustrates the four stages of erection of a portal truss which are as follows:-

1. Assembly on the ground.
2. (1) Post tensioning longtiudinal truss purlins; (2) post tensioning portal truss into an arch position.
3. Post tensioning portal truss column A to lift one side.
4. Post tensioning portal truss column B to lift the other side.
5. Complete foundation and permanent holder-down.

The description to this point has related mainly to the construction and erection of individual frames. In the construction of a building a plurality of such frames are formed on the ground side by side and interconnected by means of purlins which may or may not be of post tensioned construction. Suitable roofing material is affixed to the purlins to form the roof of the building. The roofing material may be of a variety of types such as metal sheeting, plywood, or a concrete membrane. The whole building is then erected by raising the column structures along one side of the building simultaneously and then raising those on the other side.

The invention may be applied to the construction of circular and square or rectangular structures in the manner illustrated in FIGS. 6 and 7 in which, in FIG. 6 the frames are arranged to intersect at a central point from which they radiate and in FIG. 7 frames are arranged orthogonally.

FIGS. 8, 9 and 10 illustrate the application of the invention in the case of very large buildings in which the span is such as to make it desirable to form the centre span as a complex structure made up of three separate truss sections, namely outer truss sections 23 and 24 and a central truss section 25. To the outer ends of sections 23 and 24 column structures 26 and 27 are attached respectively by means of hinge joints. A single truss cable 28 passes through the three sections 23, 24 and 25.

FIG. 8 shows this structure assembled on the ground utilizing temporary supports 29, 30, 31 and 32.

FIG. 9 shows the arrangement after the truss cable 28 as being post-tensioned and a hydraulic lifting jack 33 with an associated lifting cable 34 has been positioned at the centre of the central truss 25.

The lifting of the whole centre span is then carried out in the manner described above by tensioning cables 35 and 36. The raising of the central truss 25 is effected by means of hydraulic jack 31 and once the position shown in FIG. 10 is reached a central column 37 is fixed permanently in place and the temporary supports 29, 30, 31 and 32 removed. The form of construction illustrated in FIGS. 8, 9 and 10 could be used with structures having a span of 100 meters between each column support 25 and 26 and the central column 37.

A major problem in the erection of buildings such as aircraft hangars is the design and construction of the building in such a manner as to resist wind loads. Detailed design studies and erection of experimental buildings has shown that buildings constructed according to the invention, and utilising techniques described in the preamble, while being extremely economical in terms of material costs and erection costs are nevertheless capable of withstanding typhoon force winds.

A variety of different materials and combination of material may be used in the construction of frame structures of the invention. While in many cases all members will be of steel, concrete or timber top chord member may be used combined with steel lower chord tubes in the centre span. Timber may be used for the top chord, column members and diagonal members the whole being covered with a plywood timber covering.

The embodiments of the invention described above are given by way of example only, considerable variations being possible in the detailed design of the column structures and the centre span as will be obvious to those skilled in the art.

I claim:

1. A method of constructing and erecting a post-tensioned steel frame structure consisting in:

(1) constructing on the ground a center span of the structure comprising of a truss having an upper chord member and a lower chord member, the two chord members being interconnected so as to be spaced apart throughout their lengths and at each end;

(2) post-tensioning a cable running through the lower chord member and anchoring the end thereof to the ends of the lower chord member to induce in the center span a desired shape;

(3) locating hinge members at the end of the upper chord member and connecting thereto column structures extending outwardly beyond the end of the center span;

(4) attaching post-tensioning cables to the end of the lower chord member and extending same to the free end of each column structure;

(5) post-tensioning said last mentioned cables to produce rotational movement between said column structures and said center span about said hinge joints to move the free ends of said column structures inwardly towards each other to raise the column structures from a substantially horizontal to a substantially vertical position to bring the upper end of each column structure into a closely abutting relationship with the portion of the end of the center span lying between the upper and lower chords and maintaining them in that position by anchoring the ends of said last mentioned cables to thereby elevate the center span to a final position.

2. A method of constructing and erecting a post-tensioned steel frame structure consisting in:

(1) constructing on the ground a center span of the structure consisting of outer truss portions each having an upper chord member and a lower chord member, the two chord members being interconnected so as to be spaced apart at least at an outer end, the outer truss portions being joined by a central truss portion;

(2) post-tensioning a cable running through the lower chord members of the outer truss portions and through the central truss portions, anchoring the ends thereof to the outer ends of the lower chord members of the outer truss portions to induce in the center span a desired shape;

(3) locating hinge members at the outer ends of the upper chord members and connecting thereto column structures extending outwardly beyond the ends of the center span;

(4) attaching post-tensioning cables to the outer ends of the lower chord members and extending same to the free end of each column structure; and (5) post-tensioning said last mentioned cables to produce rotational movement between said column structures and said center span about said hinge joints to move the free ends of said column structures inwardly towards each other to raise the column structures from a substantially horizontal to a substantially vertical position to bring the upper end of each column structure into a closely abutting relationship with the portion of the end of the adjacent outer truss portion of the center span lying between the upper and lower chords thereof and maintaining them in that position by anchoring the ends of the said last mentioned cables thereby elevating the center span to a final position while simultaneously raising the center truss portion by hydraulic jack means.

* * * * *